US005091040A

United States Patent [19]

Otruba

[11] Patent Number: 5,091,040

[45] Date of Patent: Feb. 25, 1992

[54] TURRET TYPE LABELING MACHINE WITH CONTOURED VACUUM DRUM

[75] Inventor: Svatoboj Otruba, Ceres, Calif.

[73] Assignee: B & H Manufacturing Co., Inc., Ceres, Calif.

[21] Appl. No.: 518,747

[22] Filed: May 3, 1990

[51] Int. Cl.[5] ..... B65C 3/00

[52] U.S. Cl. ..... 156/566; 156/567; 156/568; 156/570; 156/571

[58] Field of Search ..... 156/566, 567, 568, 570, 156/571

[56] References Cited

U.S. PATENT DOCUMENTS

| | | | |
|---|---|---|---|
| 3,536,560 | 10/1970 | Della Vita et al. | 156/568 X |
| 4,801,348 | 1/1989 | Takagaki | 156/567 X |
| 4,944,830 | 7/1990 | Zodrow et al. | 156/567 |

*Primary Examiner*—David A. Simmons
*Assistant Examiner*—James J. Engel, Jr.
*Attorney, Agent, or Firm*—Flehr, Hohbach, Test, Albritton & Herbert

[57] ABSTRACT

Labeling machine of the turret and vacuum drum type in which the vacuum drum is formed with one or more arcuate segments on its surface generally concentric to the vacuum drum but including a leading section and a trailing section which apply pressure to the leading and trailing ends of the label to adhere them to the container and a mid-section between the leading and trailing sections, which is so shaped and configured that it is in physical contact with a label on the container or is so close to the container that the label has no substantial freedom of movement apart from its movement with the vacuum drum and its orbital movement and its winding around the container.

9 Claims, 2 Drawing Sheets

TURRET TYPE LABELING MACHINE WITH CONTOURED VACUUM DRUM

FIELD OF THE INVENTION

This invention relates to labeling machines of the type in which labels are picked up by a vacuum drum at a label pick up station from a stack of labels or as they are severed from a continuous strip of label stock, and are held on the drum surface by vacuum and transported to a label applying station, and in which containers are picked up at a container pick up station by aligned chucks on a turret and are transported to the label applying station where they contact the leading end of labels (which are released) and are wrapped around the container by spinning motion of the containers and are transported to a container exit station.

BACKGROUND OF THE INVENTION

Labeling machines of the type described above are illustrated by U.S. Pat. No. 4,108,709; also by other turret type labeling machines which are on the market. Referring to U.S. Pat. No. 4,108,709, the disclosure of which is incorporated herein by reference, each container in its turn is gripped between upper and lower chucks which are caused to spin about their common axis as the turret rotates about the turret axis. As each container reaches a line of tangency with the vacuum drum the leading end of the label on the drum is adhered to the container by an adhesive, vacuum is released from the drum surface so that the label may follow the container and wrap around it and, as the container recedes from the line of tangency with the vacuum drum, there is a segment of the label between the line where it comes into contact with the container and the line where it is still in contact with the vacuum drum. Finally, as the label becomes completely detached from the vacuum drum there is a loose end to the label which is attached to the spinning container but not to the drum, such loose end being commonly referred to as a "flagging" end.

Such unattached or flagging segments of labels are ultimately wrapped around a container, either completely as in full wrap or partially as in what is known as a "spot label". The trailing end of the label is adhered to the container by an adhesive in the case of a spot label or it overlaps and is adhered to the leading end of the label by an adhesive in the case of a full wrap.

It will be understood that segments of sheet material other than labels, for example decorative or protective sheets may be used and that the articles need not be containers. It will also be understood that, although the containers are generally cylindrical in shape, their shapes may depart from cylindrical. For simplicity "labels" and "containers" are described below and the containers are generally described as cylindrical.

In labeling machines of this type difficulties are encountered due to the freedom of movement of the unattached segment or flagging end of the label and its tendency to undergo random motion. This is particularly troublesome with lightweight, thin, limp plastic labels and/or at high speeds of labeling.

BRIEF SUMMARY OF THE INVENTION

The difficulties mentioned above are avoided or greatly diminished by providing a vacuum drum having a configuration or contour such that as a container undergoes orbital motion about the turret axis and spinning motion about its own axis, the container is at all times, until wrapping has been substantially entirely completed, either in tangent contact with the vacuum drum or is very close to the surface of the vacuum drum.

DETAILED DESCRIPTION OF THE DRAWINGS

Figure 1:
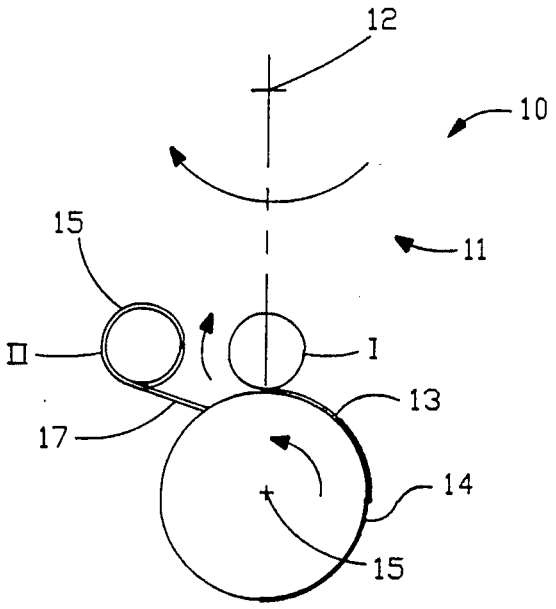
(PRIOR ART) FIG.—1
FIG. 1 is a diagrammatic top plan view of a turret type of labeling machine employing a vacuum drum such as described in U.S. Pat. No. 4,108,709 and it is shown at a stage of operation where the leading end of a label has been applied to a container and the label has been partially been wrapped around the container. Such figure illustrates the problems discussed above.

Referring now to FIG. 1 a labeling machine is shown diagrammatically and is generally designated by the reference numeral 10. It comprises a turret 11 rotating orbitally about a central turret axis 12 and carrying pairs of axially aligned chucks (not shown) such as those shown at 39 and 36 in FIG. 2 of U.S. Pat. No. 4,108,709. Each pair of chucks clamps a container such as shown at I by its ends, transports the container to a label pickup station as illustrated by the container I where it picks up the leading end of a label 13 from a rotating vacuum drum 14 which rotates about an axis 15 parallel to the turret axis 12. The container with the leading end of a label 13 attached is caused to spin in the direction shown by the arrow, thus wrapping the label around it. It will be understood that the turret is provided with means to separate each pair of chucks at a container pickup station to receive a container between them and then to move toward one another to clamp the container between the chucks and to cause the container to spin. It will also be understood that after labeling has been completed the chucks will be separated to allow removal of a labeled container, which is removed from the turret at a container delivery station.

Container II has moved with the turret away from the vacuum drum and a segment of partially applied label, indicated at 17, is unattached to the container. For a short interval of time the trailing end of the label remains unattached to the vacuum drum but later it is wrapped around the container. If the label is, for example, a limp, plastic label and/or if because of the speed of the machine there are currents of air the unattached portion of the label, particularly when its trailing end leaves the vacuum drum, is subject to random, chaotic motion which will result in faulty labeling.

Figure 2A:
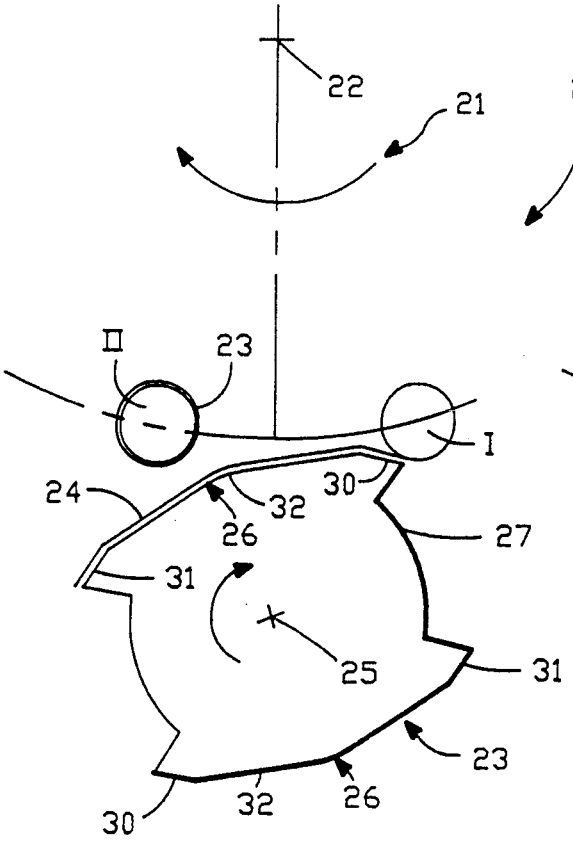
FIG. 2A is a similar view of a turret type of labeling machine in which the vacuum drum is shaped in accordance with the present invention, such view showing the situation at the commencement of labeling of a container when the leading end of the label is applied to the container.

Referring now to FIG. 2A, a turret/vacuum drum labeling machine is shown diagrammatically and is designated generally by the numeral 20. It includes a turret 21 rotating about a turret axis 22. Containers I and II are shown, container I being shown at the position of commencement of labeling. A vacuum drum is shown at 23 which transports and applies labels 24 to the containers.

The vacuum drum 23 rotates about axis 25 parallel to the turret axis 22. The drum 23 is shown with two sections or pads 26 separated by segments 27. There may, however, be only one pad 26 and one segment 27 or there may be more than two pads 26 and more than two segments 27. The pads 26 are preferably made of a hard rubber material of a type commonly used in the construction of vacuum drums for labeling machines and they are perforated to apply vacuum from the vacuum system of the machine for the purpose of holding labels on the surface of the drum by suction while being transported from the label pickup station to the label applying station, such suction being relieved at the label applying station to allow the label to part from the vacuum drum and to adhere to the container by means of adhesive.

Each pad 26 comprises a leading segment 30, a trailing segment 31 and an intervening segment 32 which are shaped and configured as follows: The leading segment 30 is slightly curved and convex and is so located that it is tangent to a container which is at the position of container I in FIG. 2A and applies pressure to the leading end of a label 24 and causes it to adhere to the container. The intervening segment 32 is so shaped and configured that it is either tangent to a container as it travels from the position shown in FIG. 2A tot he position shown in FIG. 2B and beyond or, if it is not tangent it is close enough to the container and to the label that there is no tendency of the label to move except with the vacuum drum and with the container. The segment 31, like the segment 30, is slightly curved and convex so that it applies pressure to the trailing end of the label and causes it to adhere to the leading end of the label in the case of a full wrap or directly to the container in the case of a spot label. The positions of the container and the segment 31 at the conclusion of the labeling operation are shown in FIG. 2C.

The shapes and configurations of the segments 30, 31 and 32 may be derived from trial and error or they may be determined by mathematical calculation. The segments 30 and 31 are configured so that they touch (through the intervening label) the container and apply adequate pressure to the label to adhere the label to the container or, in the case of segment 31, to adhere the trailing end to the leading end of the label. The intervening segment 32 allows more leeway in its configuration, being such as to be close enough to the container to control the label. Mathematical exactness is not essential nor need the distance separating the segment 32 and the container be constant.

Figure 2B:
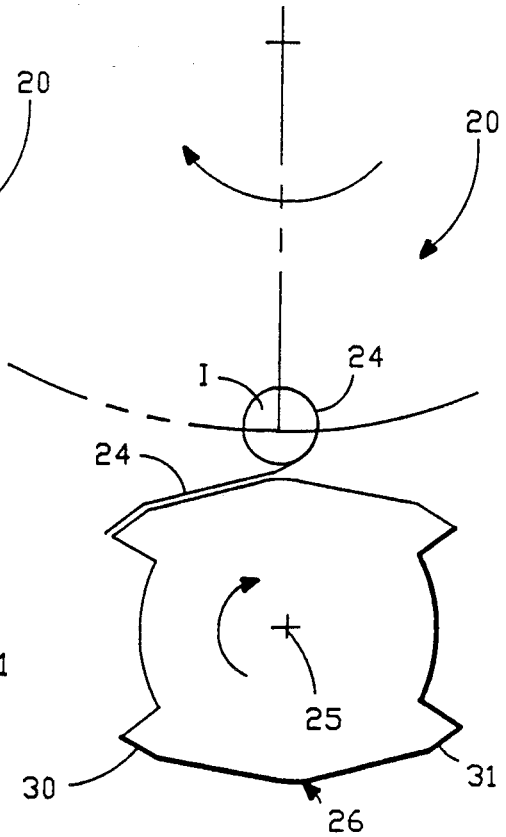
FIG. 2B is similar to FIG. 2A but shows the machine at a later stage of operation with the label partially wrapped around the container.
Figure 2C:
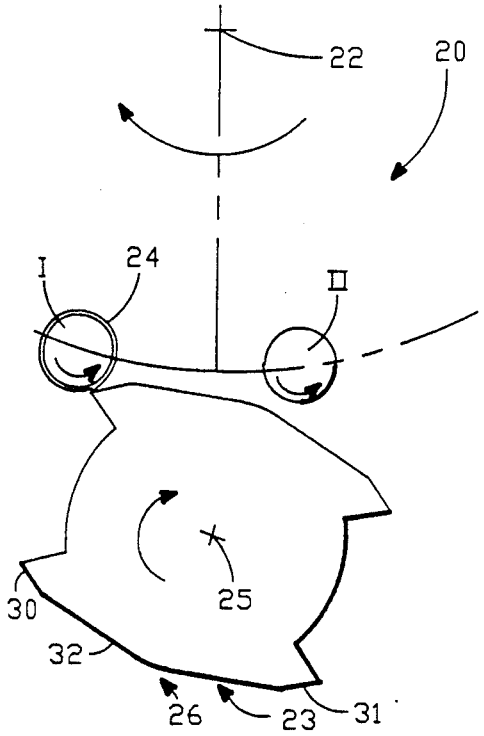
FIG. 2C is a similar view but of the final stage of labeling in which the label has been completely applied to the container and its trailing end laps over the leading end.
Figure 3A:
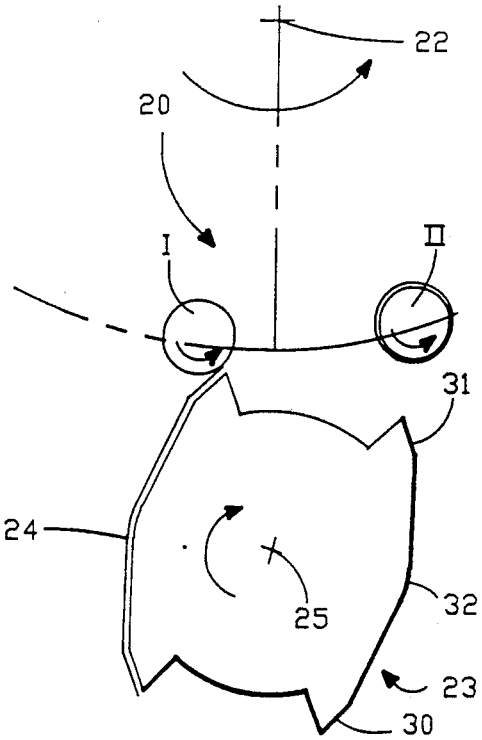
FIGS. 3A, 3B and 3C are similar to FIGS. 2A, 2B and 2C, respectively, but show a machine in which the vacuum drum and the turret are rotating in opposite directions, for example one being clockwise and the other counterclockwise.
Figure 3B:
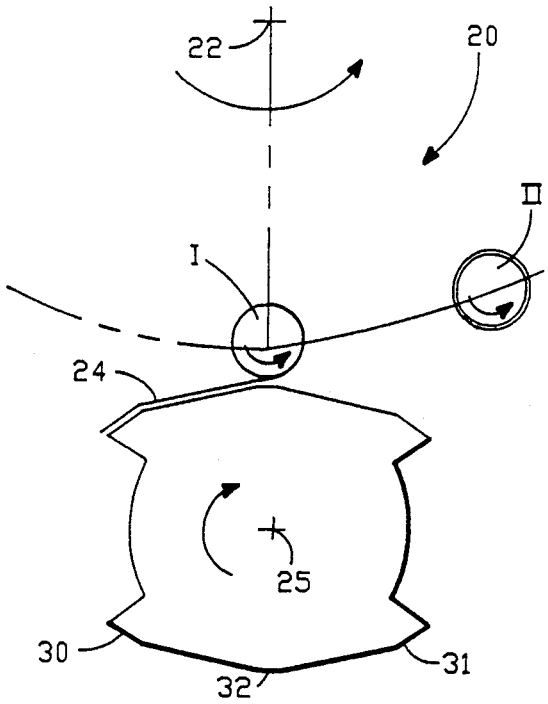
Figure 3C:
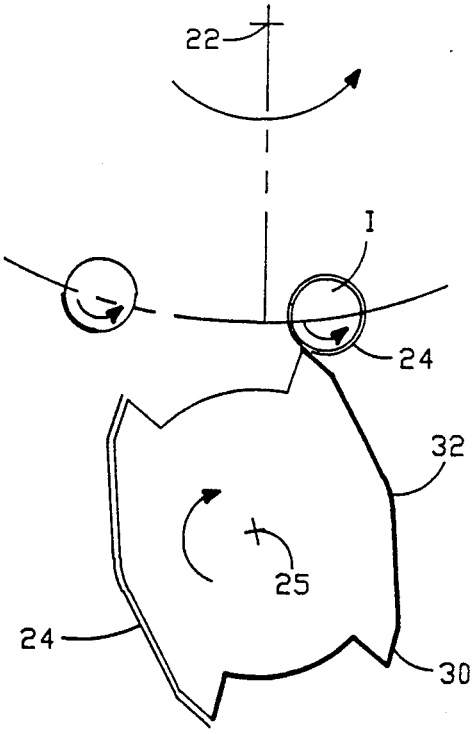

Referring now to FIGS. 3A, 3B and 3C in which the same reference numerals are used as in FIGS. 2A, 2B and 2C, the turret 21 is shown as rotating counterclockwise and the vacuum drum is shown as rotating clockwise. The containers also spin counterclockwise. The configuration of the vacuum drum 23 is the same as in FIGS. 2A, 2B and 2C. As will be seen the labels are applied in the same manner as 2A, 2B and 2C.

I claim:

1. In a turret type machine for wrapping segments of sheet material, each having a leading end and a trailing end, about articles, said machine including a turret rotatable about a central turret axis and a plurality of pairs of chucks carried by the turret, the chucks of each pair being aligned coaxially and for orbital motion about the turret axis and for spinning about their own axes parallel to the turret axis, said machine also comprising a vacuum feed member for said segments which is rotatable about an axis parallel to the turret axis and which has an arcuate surface generally parallel to the turret axis and which is capable of receiving a segment of sheet material at a segment pickup station, holding such segment on such arcuate surface by vacuum while transporting it to a segment applying station and releasing it at such station, the improvement which comprises a configuration of said arcuate surface including a leading section which acts to apply pressure to the leading end of a segment to adhere it to an article held by a pair of said chucks, a trailing section which acts to apply pressure to the trailing end of such segment to adhere it to the article or to overlap and adhere to the leading end of the segment and a mid-section between said leading and trailing sections which is so shaped and contoured that it is in contact with the orbitally moving and spinning article or is close enough thereto that there is no substantial amount of freedom of movement allowed the segment other than its orbital and spinning motions, said arcuate surface being fixed in relation to said vacuum feed member axis and said turret axis.

2. The machine of claim 1 in which said arcuate surface has a configuration such that the article is in physical contact with the arcuate surface during substantially the entire time that the segment is being wrapped around it.

3. The machine of claim 1 in which said arcuate surface has a leading end and a trailing end which are in physical contact with the article to apply pressure to the leading and trailing ends, respectively, of the segment to adhere them to the article, the section of said arcuate surface between its leading and trailing ends being in close proximity to but not in physical contact with the article, such close proximity being sufficient to control the portion of the segment bridging the gap between the arcuate surface and the article and to prevent faulty wrapping about the article.

4. The machine of any of claims 1, 2 and 3 in which said arcuate surface has a configuration to wrap segments of sheet material about cylindrical articles.

5. The machine of any of claims 1, 2 and 3 in which said arcuate surface has a configuration to wrap segments of sheet material about non-cylindrical articles.

6. A method of wrapping segments of sheet material, each having a leading end and a trailing end, about articles each of which has a longitudinal axis and a cylindrical or non-cylindrical surface parallel to said longitudinal axis and also having an upper end and a lower end, said method comprising:

(a) gripping each such article, in turn, at its ends, (b) moving each article so gripped orbitally about a central axis of orbital motion and during at least a portion of such orbital motion also spinning each article about its longitudinal axis, (c) transporting a segment of sheet material for each such article on an arcuate surface of a vacuum member rotating about a fixed axis and in a generally circular path between a segment pick up station and a segment release station, and releasing the segment at said release station, the segment being tangent to said surface of the article at said release station, said arcuate surface being fixed in relation to said fixed axis and said central axis, (d) said arcuate surface of the vacuum member having a configuration such that it applies pressure to the leading and trailing ends of each segment to adhere them to the article or, in the case of the trailing ends, to adhere them to the leading ends and such that the article remains at all times in physical contact with the arcuate surface or remains in close enough proximity thereto to exert control over the segment.

7. The method of claim 6 in which the articles are containers and the segments of sheet material are labels.

8. The method of claim 7 in which the containers are cylindrical.

9. The method of claim 7 in which the containers are non-cylindrical.

* * * * *